US009500095B2

(12) United States Patent
Pietrobon et al.

(10) Patent No.: US 9,500,095 B2
(45) Date of Patent: Nov. 22, 2016

(54) TURBINE SHROUD SEGMENT SEALING

(71) Applicant: Pratt & Whitney Canada Corp., Longueuil (CA)

(72) Inventors: John Pietrobon, Outremont (CA); Remy Synnott, St-Jean-sur-Richelieu (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 925 days.

(21) Appl. No.: 13/799,212

(22) Filed: Mar. 13, 2013

(65) Prior Publication Data

US 2014/0271105 A1 Sep. 18, 2014

(51) Int. Cl.
*F01D 9/02* (2006.01)
*F01D 11/24* (2006.01)

(52) U.S. Cl.
CPC ..... *F01D 11/24* (2013.01); *F05D 2250/141* (2013.01); *F05D 2250/191* (2013.01); *F05D 2250/231* (2013.01); *F05D 2260/201* (2013.01)

(58) Field of Classification Search
CPC ..... F01D 11/08; F01D 11/12; F01D 11/122; F01D 11/125; F01D 11/127
USPC ..... 415/170.1, 173.1, 173.4, 174.4
See application file for complete search history.

(56) References Cited

U.S. PATENT DOCUMENTS 4,365,933 A * 12/1982 Langer ..... F01D 9/041 415/200
4,621,976 A 11/1986 Marshall et al.
5,482,433 A 1/1996 Norris et al.
5,868,398 A 2/1999 Maier et al.
5,988,975 A 11/1999 Pizzi
6,910,854 B2 6/2005 Joslin
7,306,428 B2 12/2007 Schiebold et al.
8,206,092 B2 6/2012 Tholen et al.
2002/0187040 A1* 12/2002 Predmore ..... F01D 11/005 415/135
2006/0082074 A1 4/2006 Synnott et al.
2009/0220331 A1 9/2009 Shapiro et al.
2009/0269190 A1* 10/2009 Wunderlich ..... F01D 11/18 415/173.7
2010/0237571 A1* 9/2010 Durocher ..... F16J 15/0887 277/631
2013/0156556 A1* 6/2013 Franks ..... F01D 25/246 415/182.1
2013/0206739 A1* 8/2013 Reed ..... F01D 25/12 219/121.71

* cited by examiner

*Primary Examiner* — Thomas Denion
*Assistant Examiner* — Mickey France
(74) *Attorney, Agent, or Firm* — Norton Rose Fulbright Canada LLP

(57) ABSTRACT

A segmented shroud ring surrounds a circumferential array of blades of a gas turbine engine rotor. The shroud ring has a plurality of shroud segments disposed circumferentially one adjacent to another. The circumferentially adjacent shroud segments have confronting sides defining an inter-segment gap therebetween. The inter-segment gaps are sealed by a sealing band mounted to the radially outer surface of the segmented shroud ring so as to extend across the inter-segment gaps around the full circumference of the shroud ring. Impingement jet holes may be defined in the sealing band for cooling the shroud segments.

15 Claims, 5 Drawing Sheets

TURBINE SHROUD SEGMENT SEALING

TECHNICAL FIELD

The application relates generally to the field of gas turbine engines, and more particularly, to shroud segments for surrounding the blades of gas turbine engine rotors.

BACKGROUND OF THE ART

The turbine shrouds surrounding turbine rotors are normally segmented in the circumferential direction to allow for thermal expansion. Being exposed to very hot combustion gasses, the turbine shrouds usually need to be cooled. Since flowing coolant through a shroud assembly diminishes overall engine efficiency, it is desirable to minimize cooling flow consumption without degrading shroud segment durability. Individual feather seals are typically installed in confronting slots defined in the end walls of circumferentially adjacent turbine shroud segments to prevent undesirable cooling flow leakage at the inter-segment gaps between adjacent shroud segments. While such feather seal arrangements generally provide adequate inter-segment sealing, there is a continued need for alternative sealing and cooling shroud arrangements.

SUMMARY

In one aspect, there is provided a shroud assembly for surrounding a circumferential array of blades of a gas turbine engine rotor, the shroud assembly comprising: a plurality of shroud segments disposed circumferentially one adjacent to another, each shroud segment having a radially inner gas path surface and an opposed radially outer surface, wherein each pair of circumferentially adjacent shroud segments defines an inter-segment gap, and a sealing band mounted around the radially outer surface of the shroud segments and extending across the inter-segment gaps around the full circumference of the shroud assembly.

In a second aspect, there is provided a shroud assembly surrounding a row of blades of a gas turbine engine rotor, the shroud assembly comprising: a plurality of blade shroud segments disposed circumferentially one adjacent to another to form a circumferentially segmented shroud ring, an inter-segment gap being defined between each pair of adjacent blade shroud segments, each of the blade shroud segments having a body axially defined from a forward end to an aft end in a direction from an upstream position to a downstream position of a gas flow passing through the shroud assembly, and being circumferentially defined between opposite first and second lateral sides, said body including a platform having a radially inner gas path surface and an opposed radially outer back surface, and forward and aft arms extending from the back surface of the platform, said forward and aft arms being axially spaced-apart from each other, and a sealing band mounted between the forward and aft arms on the back surface of the shroud segments, the sealing band encircling the segmented blade shroud ring and circumferentially spanning all the inter-segment gaps around the circumference of the segmented shroud ring.

In a third aspect, there is provided a method for sealing and cooling a circumferentially segmented shroud ring in a gas turbine engine rotor, the method comprising: surrounding the segmented shroud ring with a sealing band configured to fully encircle the segmented shroud ring, forming a pressurized air plenum around the sealing band for urging the sealing band in sealing engagement against a radially outer surface of the segmented shroud ring, and providing impingement jet holes in said sealing band to allow some of the pressurized air in the plenum to impinge upon a radially outer surface of the segmented shroud ring.

DESCRIPTION OF THE DRAWINGS

Reference is now made to the accompanying figures, in which.

DETAILED DESCRIPTION

Figure 1:
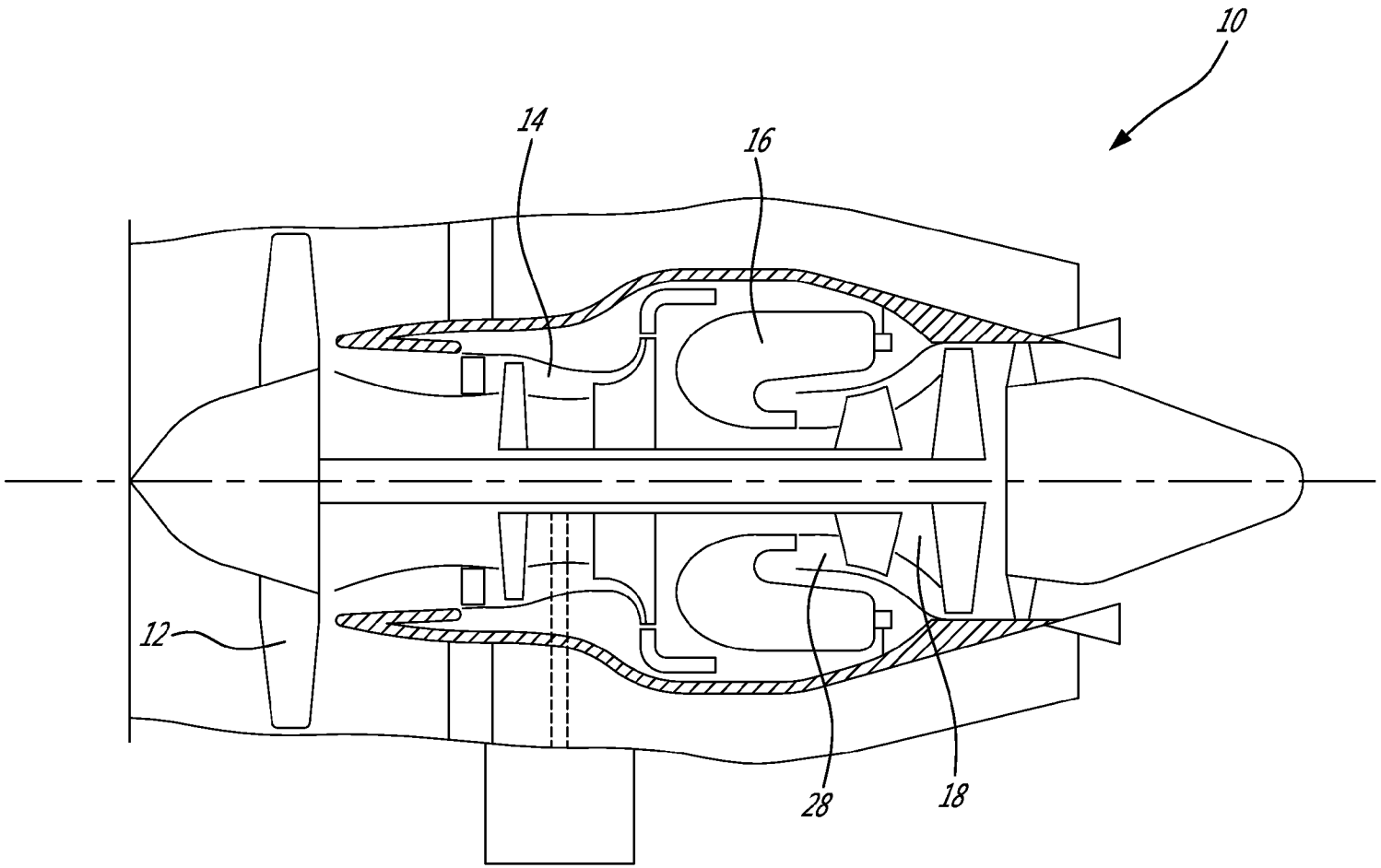
FIG. 1 is a schematic cross-section view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
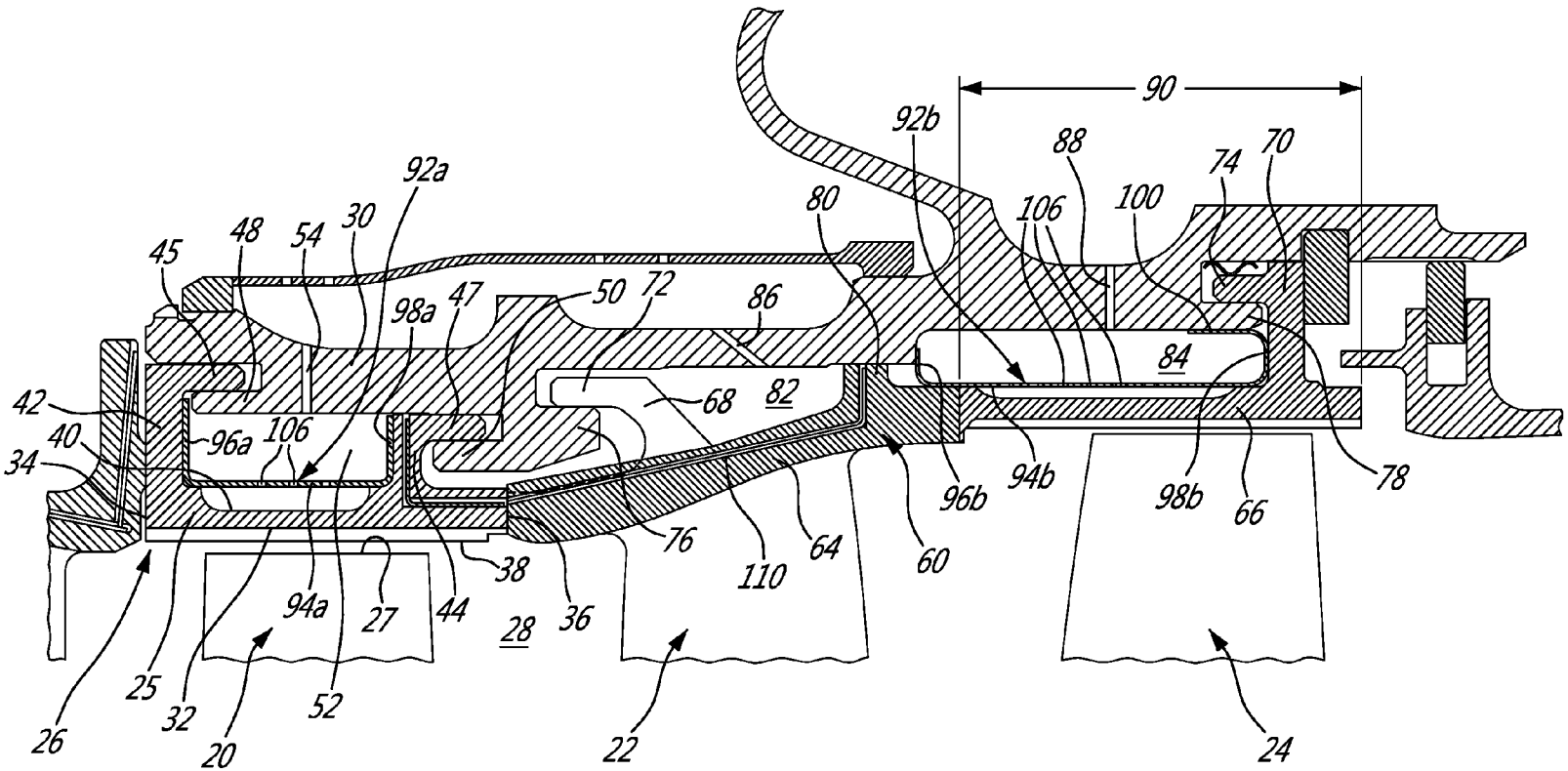
FIG. 2 is a cross-section view of a portion of the turbine section of the gas turbine engine shown in FIG. 1 and illustrating first and second integrated impingement baffle and shroud seals respectively surrounding a circumferentially segmented turbine shroud and a segmented turbine shroud integrated to an upstream segmented vane ring.

Referring to FIG. 2, it can be observed that the turbine section 18 of the engine 10 may include a number of turbine stages. More particularly, FIG. 2 illustrates a first stage of turbine rotor blades 20 axially followed by a second stage of stationary turbine vanes 22 disposed for channeling the combustion gases to an associated second stage of turbine blades 24 mounted for rotation about the engine centerline.

Figure 5:
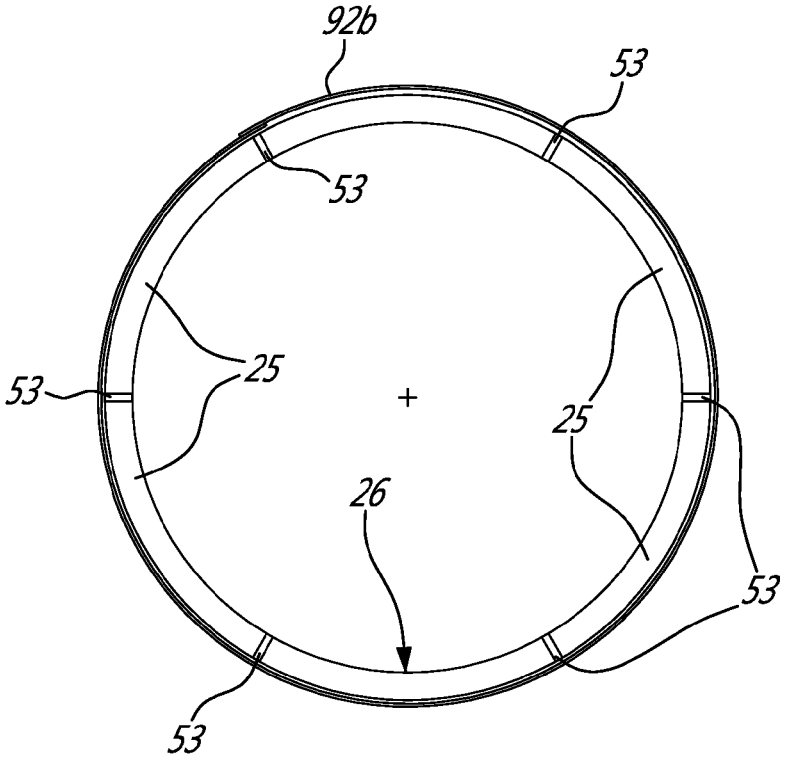
FIG. 5 is a schematic end view illustrating a sealing band mounted about a circumferentially segment shroud ring for sealing the inter-segment gaps.

Surrounding the first stage of turbine blades 20 is a stationary shroud ring 26. The shroud ring 26 is circumferentially segmented to accommodate differential thermal expansion during operation. Accordingly, the shroud ring 26 may be composed of a plurality of circumferentially adjoining shroud segments 25 (see FIG. 5) concentrically arranged around the periphery of the turbine blade tips 27 so as to define a portion of the radially outer boundary of the engine gas path 28. The shroud segments 25 may be individually supported and located within the engine by an outer housing support structure 30 so as to collectively form a continuous shroud ring about the turbine blades 20. As shown in FIG. 2, each shroud segment 25 comprises an arcuate platform 32 extending axially from a forward end 34 to an aft end 36 and circumferentially between first and second opposed ends. The platform 32 has a radially inner gas path surface 38 and an opposed radially outer back surface 40. Axially spaced-apart forward and aft arms 42, 44 extend radially outwardly from the back surface 40 of each segment. The arms 42, 44 are provided with respective axially projecting distal hooks or rail portions 45, 47 for engagement with corresponding mounting flange projections 48, 50 on the surrounding support structure 30. A shroud plenum 52 is defined between the arms 42, 44 and the radially outer back surface 40 of the platform 32 for receiving pressurized cooling air from a cooling air source, for example bleed air from the compressor 14. A feed hole 54 may be defined in the support structure 30 for directing the cooling air in the plenum 52. As well know, once the shroud ring 26 is assembled, small circumferential inter-segment gaps 53 (FIG. 5) exist between the first and second circumferential ends of adjacent shroud segments 25. As will be seen hereafter, a sealing arrangement is provided to limit cooling air leakage into the engine gas path through the inter-segment gaps.

Figure 4:
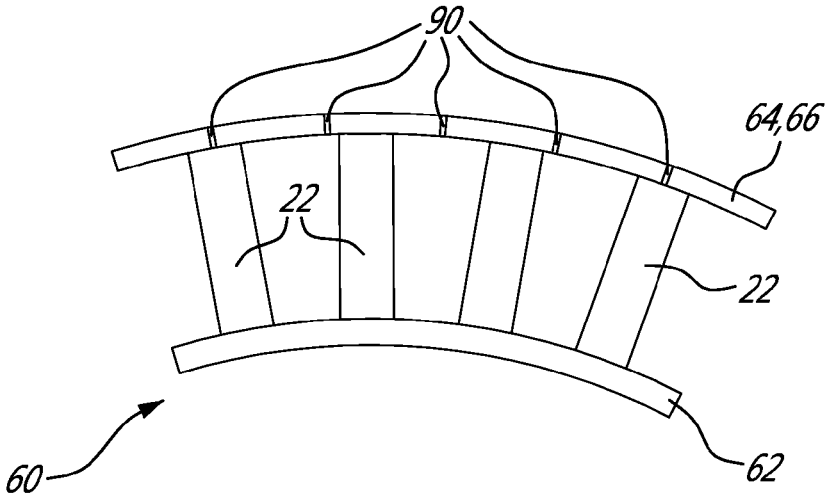
FIG. 4 is a rear end view of a split turbine shroud segment integrated to a turbine vane segment.

As shown in FIGS. 2 and 4, the second stage of turbine vanes 22 is also typically segmented. Each vane segment 60 comprises at least one vane 22 extending radially between inner and outer vane shroud segments 62, 64 that defines the radial flow boundaries for the annular stream of hot gases flowing through the vane ring. In the example illustrated in FIG. 4, each vane segment 60 is cast or otherwise suitably manufactured with four circumferentially spaced-apart vanes 22. Typically, for a given turbine stage, the blade shroud segments are separate from the vane segments. However, as shown in FIG. 2, it is herein proposed to combine the vane segments 60 and the blade shroud segments into integral parts. More particularly, each vane segment 60 may be cast with a shroud blade portion 66 extending rearwardly from the outer vane shroud 64. The integrated structure may be provided with a forward support arm 68 extending radially outwardly from the vane shroud 64 and an aft support arm 70 extending radially outwardly from the blade shroud portion 66. The forward and aft support arms 68, 70 are provided with respective axially projecting distal hooks or rail portions 72, 74 for engagement with corresponding mounting flange projections 76, 78 on the surrounding support structure 30. An intermediate ridge 80 may project radially outwardly from the integrated vane and blade shroud to allow for the formation of separate cooling air plenums 82, 84 for the vane and blade shroud portions 64, 66. The ridge 80 is configured for radially abutting a radially inner surface of the surrounding support structure 30. Separate feed holes 86, 88 may be provided in the support structure 30 for individually feeding the plenums 82, 84 with cooling air.

The blade shroud portion 66 of each integrated segment will be classified for different rotor tip diameters. For enhance tip clearance control, multiple blades shroud segments may be incorporated in the same cast vane segment. The integrated approach has several benefits including: less part count, cost and weight reduction, reduced secondary air leakage and smoother gas path, and durability improvement as the TSC is not directly exposed to gas path conditions. Also the vane and shroud segment parts are designed to the same life target, so they should be replaced at overhaul.

Referring concurrently to FIGS. 2 and 4, it can be observed that the blade shroud portion 66 of each integrated segment may be slotted either mechanically (i.e. EDM, grinding, etc.) or cast-in, to minimize thermal stress and blade shroud uncurling. The number of slots 90 depends on static structures requirements (uncurling, thermal stress, etc.). In the embodiment illustrated in FIG. 4, five circumferentially spaced-apart slots 90 are defined in the blade shroud portion 66 of an integrated quad vane segment. As shown in FIG. 2, each slot 90 may extend axially from the aft end of the integrated blade shroud portion to a location upstream of the blades 24 relative to the flow of gases flowing through the engine gas path 28.

As shown in FIG. 2, a sealing band 92*a*, 92*b* may be disposed in each of the plenums 52, 84 to seal all the inter-segment gaps (such as the ones shown at 53 in FIG. 5) around the segmented shroud rings and, thus, limit cooling air leakage from the plenums 52, 84 into the engine gas path 28. Each sealing band 92*a*, 92*b* is configured to be fitted in sealing engagement with the boundary surfaces of the associated plenum. The pressurized air directed in the plenums 52, 84 may be used to urge the sealing bands 92*a*, 92*b* in proper sealing engagement with the plenum boundary surfaces. The first sealing band 92*a* has a generally C-shaped cross-section including an annular base 94*a* and forward and aft radially outwardly extending annular sealing faces 96*a*, 98*a*. The forward and aft sealing faces 96*a*, 98*a* are urged by the pressurized air in uniform sealing contact with the forward and aft arms 42, 44. Likewise, the annular base 94*a* is urged in sealing contact with the radially outer surface of the circumferentially segmented shroud ring 26. Similarly, the second sealing band 92*b* has an annular base 94*b* and forward and aft annular sealing faces 96*b*, 98*b*. The aft sealing face 98*b* may have an axially forwardly bent end portion 100 for engagement with a radially inner surface of the support structure 30 for sealing the aft hook interface between the shroud and support structure. The forward annular face 96*b* of the sealing band 92*b* is urged in sealing engagement against a corresponding axially facing surface of the support structure 30. The aft annular sealing face 98*b* is urged in sealing engagement with the aft arm 70. The annular base 94*b* is urged in sealing engagement with the radially outer surface of the blade shroud portions 66 of the segmented blade shroud ring.

Figure 6:
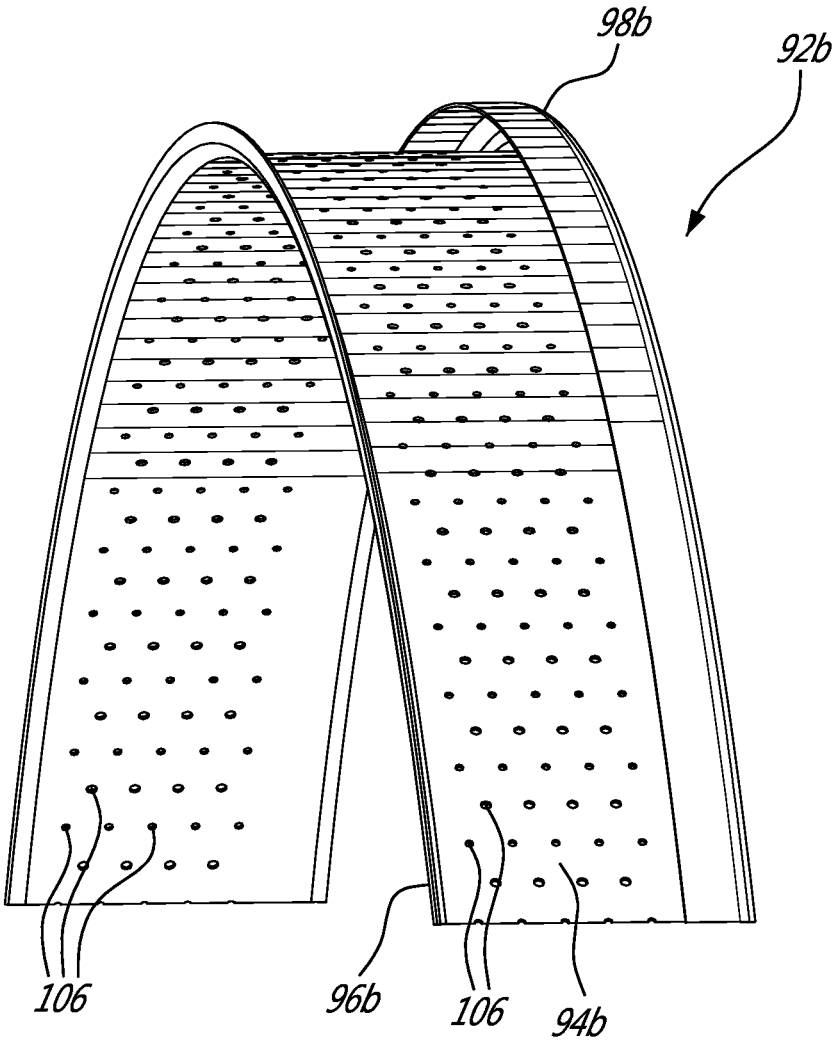
FIG. 6 is a isometric view of a portion of the inter-segment sealing band shown in FIG. 5.

Each sealing band 92*a*, 92*b* covers 360 degrees and, thus, extends across the inter-segment gaps around the full circumference of the associated segmented shroud. The second sealing band 92*b* also seals the portion of the slots 90 extending forwardly from the aft support arm 74. Each sealing band 92*a*, 92*b* may be provided in the form of a full ring, a single split ring with overlapping end portions (FIG. 3) or a single split ring with a butt joint. Sheet metal may be used to form the sealing bands. Impingement jet holes 106 (FIGS. 2 and 6) may be defined in the sealing bands 92*a*, 92*b* to allow the same to also act as impingement baffles for cooling the shroud segments. A portion of the air directed in the plenums 52, 84 can thus flow through the impingement jet holes 106 for impinging upon the underlying radially outer surface of the segmented shroud rings.

Figure 3:
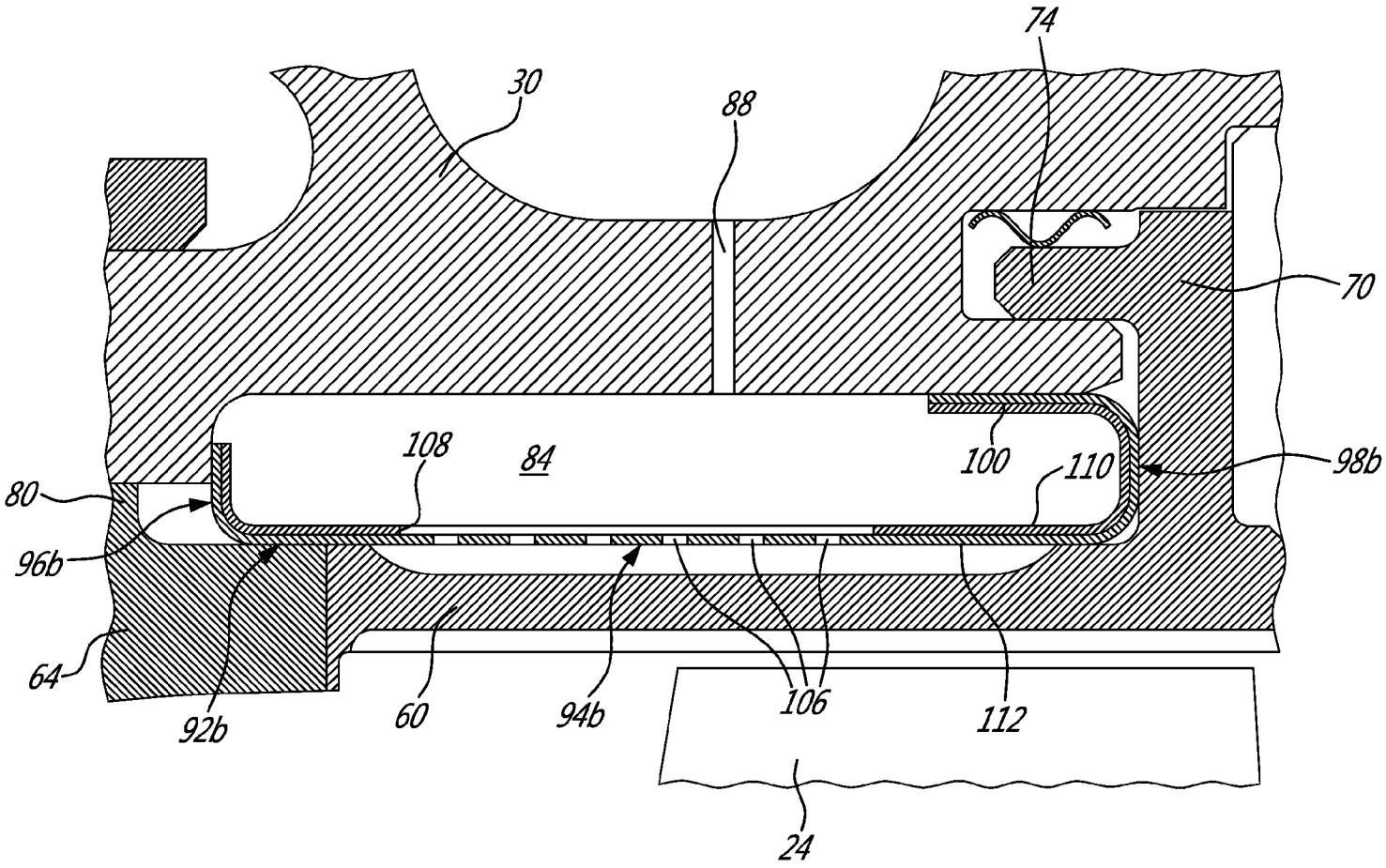
FIG. 3 is an enlarged cross-section view illustrating the integrated impingement baffle and shroud seal surrounding the full periphery of a circumferentially segmented turbine blade shroud.

As shown in FIG. 3, if the sealing bands 92*a*, 92*b* are provided with overlapping end portions, a window opening 108 may be defined in the radially outer base layer 110 in order not to block the underlying impingement jets 106 defined in the radially inner base layer 112. The window opening 108 may be oversized to ensure proper registry between the window opening 108 and the underlying impingement jet holes 106 when the overlapping end portions of the sealing band 92*a*, 92*b* slide relative to each other to accommodate thermal growth during engine operation. The use of sealing bands 92*a*, 92*b* to seal the inter-segment gaps instead of conventional feather seals result in less part count. It also provides cost reduction (eliminate feather seal slots and feather seals). It also contributes to reduce the assembly time. Finally, it may result in reduced secondary air leakage.

It is noted that conventional feather seals 110 (FIG. 2) may still be used to prevent the air directed into the plenum 82 surrounding the second stage of vanes 22 to leak into the engine gas path 28 via the inter-segment gaps in the shroud vane portion 64 of the integrated vane-blade shroud segments.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A shroud assembly for surrounding a circumferential array of blades of a gas turbine engine rotor, the shroud assembly comprising: a plurality of shroud segments disposed circumferentially one adjacent to another, each shroud segment having a radially inner gas path surface and an opposed radially outer surface, wherein each pair of circumferentially adjacent shroud segments defines an inter-segment gap, and a sealing band mounted around the radially outer surface of the blade shroud segments and extending across the inter-segment gaps around the full circumference of the shroud assembly, the sealing band including a split ring having opposed overlapping end portions adapted to circumferentially slide one over the other and forming a radially outer end portion and a radially inner end portion, wherein the radially outer end portion has a window opening defined therein in registry with a plurality of impingement holes defined in the radially inner end portion of the split ring.

2. The shroud assembly defined in claim 1, wherein the impingement holes are in flow communication with a source of cooling air for directing cooling jets against the radially outer surface of the shroud segments.

3. The shroud assembly defined in claim 2, wherein the sealing band consists of a single split sheet metal loop.

4. The shroud assembly defined in claim 1, wherein each shroud segment extends integrally aft from a radially outer vane shroud of an upstream vane segment.

5. The shroud assembly defined in claim 4, wherein at least one slot extends axially from an aft end of each of the shroud segments between the radially inner gas path surface and the opposed radially outer surface thereof.

6. The shroud assembly defined in claim 5, wherein the at least one slot is sized to extend axially upstream of the array of blades of the gas turbine engine rotor.

7. The shroud assembly defined in claim 5, wherein the at least one slot comprises at least two circumferentially spaced-apart slots.

8. The shroud assembly defined in claim 5, wherein the sealing band extends circumferentially over all the slots of the shroud segments.

9. The shroud assembly defined in claim 1, wherein axially spaced-apart forward and aft arms extend from the radially outer surface of each of the shroud segments, and wherein the sealing band is disposed between said forward and aft arms.

10. The shroud assembly defined in claim 1, wherein the sealing band has a generally radially outwardly open C-shaped cross-section.

11. A shroud assembly surrounding a row of blades of a gas turbine engine rotor, the shroud assembly comprising: a plurality of blade shroud segments disposed circumferentially one adjacent to another to form a circumferentially segmented shroud ring, an inter-segment gap being defined between each pair of adjacent blade shroud segments, each of the blade shroud segments having a body axially defined from a forward end to an aft end in a direction from an upstream position to a downstream position of a gas flow passing through the shroud assembly, and being circumferentially defined between opposite first and second lateral sides, said body including a platform having a radially inner gas path surface and an opposed radially outer back surface, and forward and aft arms extending from the back surface of the platform, said forward and aft arms being axially spaced-apart from each other, and a sealing band mounted between the forward and aft arms on the back surface of the shroud segments, the sealing band encircling the segmented blade shroud ring and circumferentially spanning all the inter-segment gaps around the circumference of the segmented shroud ring, the sealing band including a split ring having opposed overlapping end portions adapted to circumferentially slide one over the other and forming a radially outer end portion and a radially inner end portion, wherein the radially outer end portion has a window opening defined therein in registry with a plurality of impingement holes defined in the radially inner end portion of the split ring.

12. The shroud assembly defined in claim 11, wherein each of the blade shroud segments is integrally cast with a vane segment to provide an integrated vane and blade shroud segment, and wherein the blade shroud segment of each of the integrated vane and blade shroud segment is axially slotted.

13. The shroud assembly defined in claim 12, wherein each blade shroud segment has at least one slot extending thicknesswise through the platform thereof, and wherein the at least one slot in all of the blade shroud segments is at least partly covered by the sealing band surrounding the circumferentially segmented shroud ring.

14. A method for sealing and cooling a circumferentially segmented shroud ring in a gas turbine engine, the method comprising: surrounding the segmented shroud ring with a sealing band configured to fully encircle the segmented shroud ring, forming a pressurized air plenum around the sealing band for urging the sealing band in sealing engagement against a radially outer surface of the segmented shroud ring, and providing impingement jet holes in said sealing band to allow some of the pressurized air in the plenum to impinge upon a radially outer surface of the segmented shroud ring, wherein the sealing band is a split ring having overlapping end portions, the overlapping end portions including radially inner and outer layers, and wherein the method further comprises: registering a window opening in the radially outer layer with a plurality of the impingement jet holes in the radially inner layer.

15. The method defined in claim 14, the surrounding step comprises mounting the sealing band between axially spaced-apart arms projecting radially outwardly from the radially outer surface of the segmented shroud ring.

* * * * *